United States Patent [19]

Blair et al.

[11] Patent Number: 4,925,400

[45] Date of Patent: May 15, 1990

[54] ESD PROTECTED ELECTRICAL CONNECTOR AND ESD GROUNDING CLIP THEREFOR, AND CIRCUIT PANEL CONNECTOR ASSEMBLY AND METHOD OF ASSEMBLING SAME

[75] Inventors: Bryce W. Blair, Hummelstown; Jeffrey M. Norton, Lebanon; Daniel E. Stahl, Dauphin, all of Pa.

[73] Assignee: AMP Incorporated, Harriburg, Pa.

[21] Appl. No.: 252,220

[22] Filed: Sep. 30, 1988

[51] Int. Cl.[5] ..... H01R 13/629

[52] U.S. Cl. ..... 439/374; 29/842; 439/92; 439/609; 439/681

[58] Field of Search ..... 439/92, 95, 96, 101, 439/61, 62, 69, 609, 680, 681, 374; 29/842, 859

[56] References Cited

U.S. PATENT DOCUMENTS

| | | | |
|---|---|---|---|
| 3,491,330 | 9/1967 | Barnhart et al. . | |
| 3,731,259 | 5/1973 | Occhipinti . | |
| 3,987,344 | 10/1976 | Ambruoso et al. | 439/101 X |
| 4,653,826 | 3/1987 | Burgess et al. . | |
| 4,664,456 | 5/1987 | Blair et al. . | |

FOREIGN PATENT DOCUMENTS

| | | |
|---|---|---|
| 0006100A1 | 1/1980 | European Pat. Off. . |
| 1161553 | 8/1969 | United Kingdom . |
| 1349607 | 4/1974 | United Kingdom . |
| 1437998 | 6/1976 | United Kingdom . |
| 2036717A | 7/1980 | United Kingdom . |

OTHER PUBLICATIONS

AMP Data Sheet 80-568, "AMP Metrimate Drawer Connector" Apr., 1981; AMP Incorporated, Harrisburg, Pa.

ITT Cannon Catalog, "D Subminature Rectangular Connectors," pp. 212, 228, 229; ITT Corporation, N.Y.

*Primary Examiner*—Eugene F. Desmond

*Attorney, Agent, or Firm*—Anton P. Ness

[57] ABSTRACT

A connector which has alignment holes to receive alignment posts of a mating connector, includes conductive clips in each alignment hole having forwardly extending spring arms to be engaged and deflected laterally by forward ends of respective alignment posts. The clip spring arms discharge the electrostatic potential between the connectors upon being engaged by the alignment posts to chassis ground, when the clips are in conductive engagement with the shielding of the connector and the alignment posts are conductive and in conductive engagement with the shielding of the mating connector and to conductive framework to which the mating connector is mounted. The clips can have a spring arm extending rearwardly from the connector housing to be engaged by the shielding of the connector upon complete assembly. The alignment posts can be force fit into a metal shell of the mating connector through holes precisely aligned with reference holes of the mating connector housing. When the mating connector is mounted to a support plate of a control unit with the terminals thereof terminated to an array of contact sections of a mother board secured to the support plate, the alignment posts can extend through reference holes of the support plate located with respect to the contact section array and can locate the metal shell with respect to the housing and protect the housing terminals and their mother board terminations when the metal shell is placed over the housing and fastened to the support plate.

19 Claims, 6 Drawing Sheets

ESD PROTECTED ELECTRICAL CONNECTOR AND ESD GROUNDING CLIP THEREFOR, AND CIRCUIT PANEL CONNECTOR ASSEMBLY AND METHOD OF ASSEMBLING SAME

FIELD OF THE INVENTION

The present invention relates to the field of electrical connectors and more particularly to means for grounding shielded electrical connectors.

BACKGROUND OF THE INVENTION

In particular instances mating electrical connectors are brought into mated engagement remote from the ability of a person to manipulate them into proper axial and angular alignment necessary for their corresponding terminals to properly engage and mate in associated pairs. For these connectors their movement together is mechanically constrained and is based on being guided by means on the framework to which they are mounted into approximately the proper axial and angular alignment relative to each other. However, especially on high density connectors having many small terminals, precise alignment is necessary which cannot be practically provided by the framework guiding means, so the connectors must include integral alignment mechanisms which complete the alignment prior to the mating engagement of the terminals. Such precise alignment also assures that the keying mechanisms operate appropriately, to allow keying of connectors intended to mate, and disallow mating of connectors not intended to mate.

Conventional alignment mechanisms include a spaced pair of sturdy elongated alignment posts of substantial diameter extending forwardly from one connector received into corresponding holes of the other connector. Such connectors include rack and panel connectors where one of the connectors is float mounted on its framework and thus is capable of incremental lateral movement, such as are sold by AMP Incorporated, Harrisburg, Pennsylvania under the trade designation METRIMATE Drawer Connector and also connectors such as are disclosed in U. S. Pat. No. 4,664,456. Tapered frustoconical bearing surfaces at the leading ends of the alignment posts engage corresponding tapered frustoconical bearing surfaces comprising entrances to the corresponding holes when the connectors near each other, because the connectors are commonly slightly misaligned both axially and angularly. Upon engagement of the bearing surfaces, the connector permitted to incrementally adjust will move and align itself with the fixed other connector as the alignment posts enter fully into the corresponding holes, the alignment posts being long enough to effect axial alignment of the connectors prior to mating engagement of the contact terminals.

Certain rack and panel connectors are known which are provided with metal plating on the posts and on the wall surfaces of the corresponding holes, the metal plating being conductively connected to chassis ground, which serves to enable discharge of any electrostatic potential (ESD) existing between the connectors prior to the mating of the contact terminals. Theoretically, if the connectors were approaching each other in precise alignment the bearing surfaces of the alignment posts and the corresponding posts would not engage. Thus if the bearing surfaces of the posts and holes were conductive, but no engagement occurred, no discharge would occur of the electrostatic potential to ground prior to engagement of the contact terminals.

Although unlikely, that possibility is substantial enough so that ESD protection is not considered assured. In addition, there is a more probable situation wherein the connectors are almost aligned in which case the bearing surfaces would engage only in the latest stages of alignment post entry; it is possible that discharge could occur elsewhere in the connector by nearly touching conductive elements.

It is desirable to obtain a mating pair of connectors which align themselves during a remote or mechanically constrained axial mating procedure and which provide for assured protection against electrostatic potential influence on the electrical connections being established between the connectors and the systems being connected.

Electrical connectors are known for the transmission of electrical signals which must be protected from electromagnetic and radio frequency interference (EMI/RFI), by providing conductive shielding completely around the connectors in their mated state, with the shielding being electrically connected to a conductive grounding shield of the electrical cables as if it were a continuous extension thereof. The conductive shielding of the connectors is most commonly in the form of metal shells within which are inserts of dielectric material housing the terminals terminated to the respective conductor wires of the cables; conductive shielding can also take the form of metallized plating on plastic connector housings. When the connectors are in their mated state there must be no axial gap between the shells laterally of the terminals therewithin, and there must be an electrical connection between the shells of the mating connectors upon mating, preferably a plurality of such connections surrounding the housings therewithin. The conductive shells of the respective connectors enter into grounding engagement with each other prior to terminal mating.

Such a system of EMI/RFI protected connectors is disclosed in U.S. Pat. No. 4,808,115 for a "Line Replaceable Connector Assembly for use with Printed Circuit Boards", wherein the dielectric housing containing the terminals of the LRM connector precisely aligns itself with the mother board connector by incrementally moving itself laterally within its shell in response to a forwardly extending alignment rib entering into a recess of the mother board connector. The disclosed grounding engagement between the respective shells is relatively independent of precise alignment of the connectors. The LRM shell is secured to cover plates of the LRM which are fastened to a central cool plate having a pair of flanges extending outwardly from opposing sides of the LRM which move along and are constrained by opposed LRM-guiding channels along side walls of the enclosure of the control unit extending outwardly from the mother board connector and approximately aligned therewith. The forward end of the LRM shell is laterally spaced from the connector housing and receives the forward end of the mother board connector shell thereinto. The forward end of the LRM shell includes mounted peripherally around its inner surface a continuous strip of EMI spring fingers extending inwardly and rearwardly which engage the mother board connector shell's forward end; the spring fingers being resilient can forgive the shells being only approximately instead of precisely aligned with each other while establishing an assured grounding engagement between the shells peripherally around the housings.

After insertion, alignment and mating, conventional wedging lock mechanisms may be used which are adjusted to wedge and lock the LRM in place within the opposing channels. The mother board connector shell is rigidly mounted to the framework of the control unit and is electrically connected to chassis ground.

It is also desirable to provide a system of matable connectors which align themselves during mating, and which are protected against EMI/RFI as well as against ESD.

It is further desirable that the system of aligning the connector housings also maintain a metal shell of the fixedly mounted connector housing in precisely located relationship with its housing to enable keying elements secured to the metal shell to be aligned with cooperating keying elements of the mating movable connector.

SUMMARY OF THE PRESENT INVENTION

The present invention includes an alignment mechanism for mating first and second shielded electrical connectors comprising a pair of sturdy conductive alignment posts on the second one of the connectors and grounding clips mounted in the alignment post-receiving holes of the first connector. The grounding clips include at least one post-engaging spring arm and preferably an opposed pair of such spring arms which extend forwardly and inwardly toward the center axis of the alignment post-receiving hole, concluding in free ends adapted to be engaged and deflected by the alignment post forward end without stubbing. Each grounding clip assuredly engages the respective alignment post during alignment just prior to mating of the connectors and prior to any other physical engagement between any portions of the connectors with each other or close approach of any conductive portions of either connector with terminal portions of the other. The spring arms are deflected radially outwardly by the alignment post which then proceeds forwardly into the post-receiving hole and commonly is aligned by bearing engagement with forward surface portions of the hole, thus aligning the connectors relative to each other.

The grounding clip is conductively connected to the shielding of the first connector rearwardly of the mating face of the connector; the alignment post is conductively connected to the shielding of the second connector; one of the connector shields is conductively connected to chassis ground. The first physical engagement occurring by engagement of the spring arms of one of the connectors with the alignment posts of the other, assures that the electrostatic potential is discharged prior to any subsequent connector/connector engagement. The grounding clip may have a rearwardly extending spring arm which is shaped to be engaged and deflected against spring bias by a surface of the shielding shell of the connector during assembly and remain in conductive engagement therewith.

According to another aspect of the invention, the alignment posts which are part of the second connector hold the metal shell thereof in aligned relationship with the housing thereof, enabling the keying elements of the connector assembly to be mounted to the metal shell instead of the dielectric housing. The keying elements must be appropriately aligned with corresponding keying elements of the mating connector to key the connectors appropriately during mating. Intermediate portions of the alignment posts are force-fitted into and through holes of the metal shell, and rearward sections of the posts will be received into very closely dimensioned apertures through flanges of the connector housing which apertures are precisely located to serve as references to the terminal-containing passageways of the housing.

In a particular embodiment the post-containing connector may be a mother board connector, and the other connector containing the grounding clips may be a portion of a line replaceable module (LRM) for electrically connecting the module with a mother board of a control unit for a plurality of such modules. The alignment posts serve to align the metal shell with the connector housing of the mother board connector, and to maintain the alignment of both with the mother board during control unit assembly: rearwardmost portions of the posts extend into closely dimensioned apertures of the metal support plate, where the support plate apertures are precisely located with respect to the array of plated through-holes of the mother board secured beneath the support plate into which elongate post contact sections of the connector terminals are disposed. Upon precise co-alignment of the housing and metal shell with the mother board, fastening means may then secure the housing and shell to the support plate and establish assured conductive engagement of the metal shell and alignment posts to chassis ground. Thus the alignment posts serve as mechanisms for facilitating precision assembly of the control unit.

It is an objective of the present invention to assure that electrostatic potential between mating connectors is discharged to ground prior to any electrical elements of either of the connectors engaging or approaching closely to each other or to any conductive element of the other connector.

It is another objective to utilize the alignment posts to align the metal shell with the housing of the postcontaining connector, enabling keying elements to be secured to the shell in locations appropriate for proper keying with cooperating keying elements of the mating connector, enabling fabrication of the connector without securing the posts and keying elements directly to the plastic housing or molding the housing integrally about the metal posts.

An embodiment of the present invention will now be described with reference to the accompanying drawings.

DETAILED DESCRIPTION OF THE PREFERRED EMBODIMENTS

Figure 1:
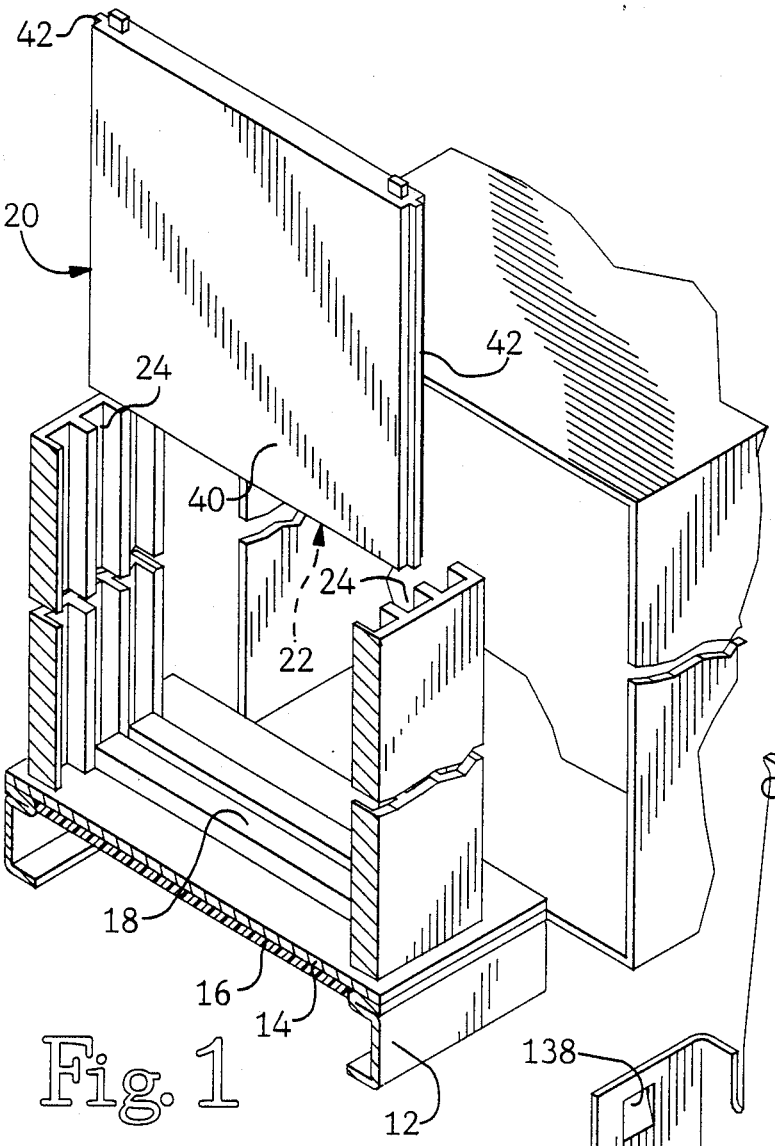
FIG. 1 is a perspective view of the mother board connector having alignment posts, and the module connector having post-receiving holes spaced therefrom about to be aligned and mated therewith.
Figure 2A:
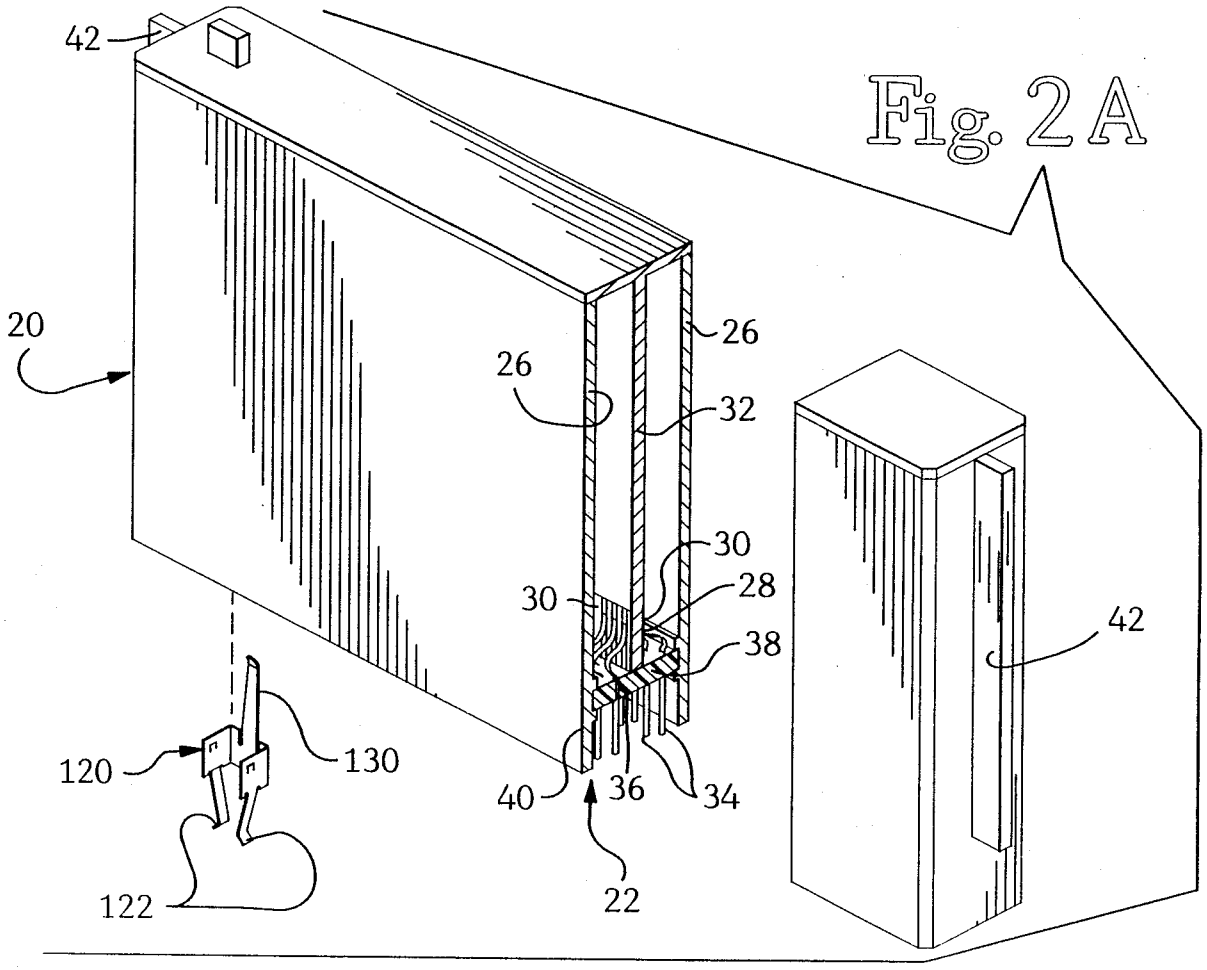
FIG. 2A is a part section view of an LRM showing a module connector mounted therein and one of the grounding clips exploded therefrom.
Figure 2B:
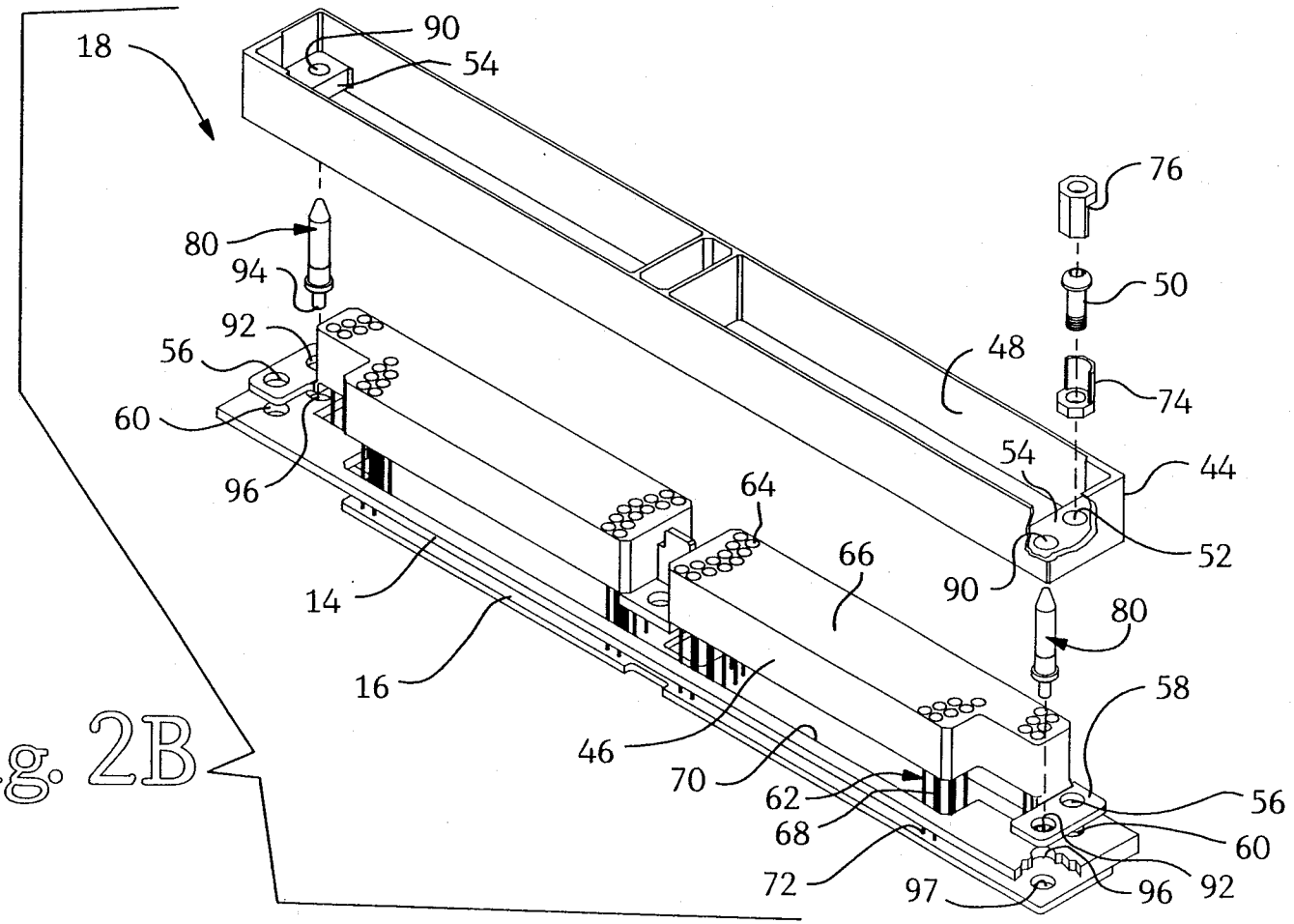
FIG. 2B is a part section view of the control unit framework showing the mother board connector and the alignment posts and fastening elements exploded therefrom.

FIGS. 1, 2A and 2B show a portion of a control unit 10 having framework 12 including a metal support plate 14, a mother board 16, one of a plurality of mother board connectors 18 mounted thereon, and one of a plurality of line replaceable modules (LRMs) 20 having a module connector 22 secured on the forward end thereof matable with mother board connector 18. LRM 20 is insertable into the control unit 10 and is constrained to move along fixed opposing channels 24 of the framework 12 which approximately align the LRM with the associated mother board connector 18. The LRM 20 is of the type similar to that disclosed in U.S. Pat. No. 4,808,115 and has a pair of aluminum metal covers 26 for EMI/RFI shielding and physical protection for the electronic package 28 secured therewithin, which package is electrically connected by module connector 22 to the mother board 16 of the control unit. Electronic package 28 can comprise VHSIC circuit cards 30 mounted onto side surfaces of an aluminum cool plate member 32, and electrical and electronic components connected to circuit paths of the cards. Terminals 34 of module connector 22 are electrically connected to the circuit paths at the forward end of electronic package 28 and disposed within respective passageways 36 of dielectric housing 38 of module connector 22. Forward ends of metal covers 26 comprise a shield 40 extending completely around and also forwardly of housing 38 and within which housing 38 is float mounted. Cool plate member 32 includes flanges 42 extending along both sides of LRM 20 which are disposed within respective channels 24.

Mother board connector 18 includes a metal shell 44 made of heat treated, machined aluminum for shielding and protection, and a dielectric housing 46 within large cavity 48 of metal shell 44 and molded for example from polyphenylene sulfide. Metal shell 44 is fixedly mounted to support plate 14 by fasteners 50 extending through apertures 52 in shell flanges 54, through apertures 56 in housing flanges 58, and threadedly received into apertures 60 of support plate 14. A plurality of terminals 62 are disposed within respective passageways 64 of housing 46, extending rearwardly from mating face 66 thereof to post contact sections 68 extending rearwardly from housing 46 through large cutout 70 of support plate 14 and secured within plated through-holes 72 of mother board 16. Octagonal keying elements 74 of mother board connector 18 cooperate with corresponding keying elements 76 of module connector 22 to allow mating with the appropriate one of the LRMs while not permitting mating with another and inappropriate LRM. To assure appropriate engagement of the plurality of terminals 62 with mating ones of the terminals 34 of module connector 22, precise connector alignment is necessary which cannot be assured by channels 24 of the control unit framework 12 to which the mother board is mounted.

Figure 4:
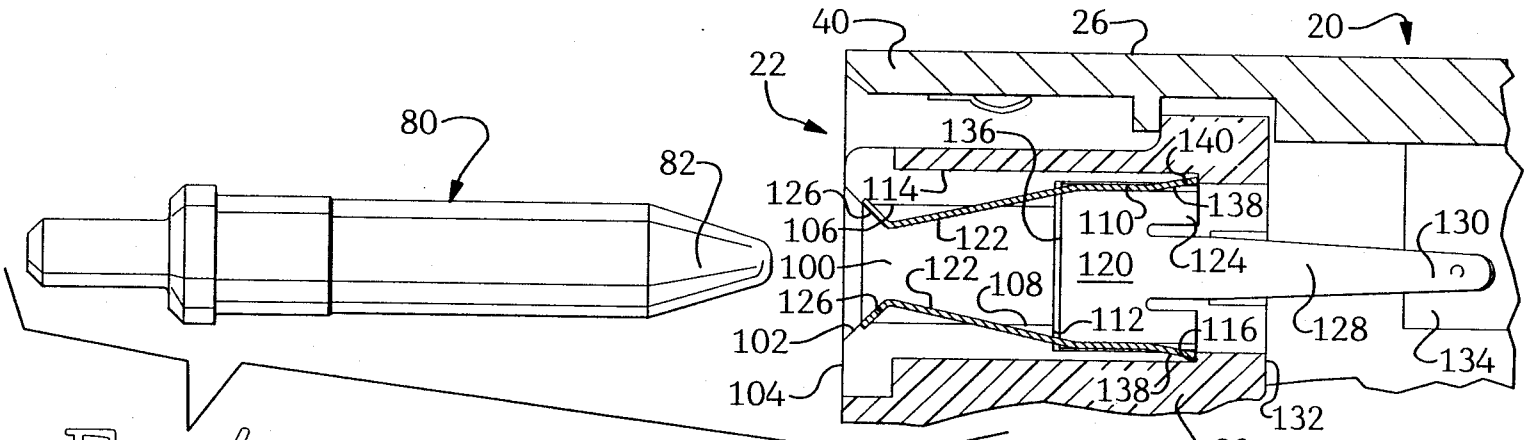
FIGS. 4 and 5 are longitudinal section views of the clip of FIG. 3 mounted in a post-receiving hole, with a post spaced therefrom and entering said hole respectively.

Referring to FIG. 4, precise alignment is achieved utilizing at least a pair of cylindrical alignment posts 80 secured to mother board connector 18 in precise reference relationship to the terminals thereof, extending axially forwardly from mating face 66 of mother board connector 18 and concluding in frustoconical forward ends 82. Module connector 22 is secured to the LRM in a manner permitting incremental lateral movement with respect to metal covers 26 as described in U.S. Pat. No. 4,808,115, and module connector 22 includes post-receiving holes 100 corresponding to alignment posts 80 and in precise reference to the terminals of the module connector, extending axially rearwardly from chamfered lead-in surface portions 102 along mating face 104 of module connector 22. Side walls 106 of square forward portions 108 of post-receiving holes 100 are closely dimensioned to correspond with the diameter of corresponding alignment posts 80. During axial movement of LRM 20 toward mother board 16 just prior to mating engagement of the connectors, frustoconical forward ends 82 of alignment posts 80 will enter corresponding ones of holes 100 and engage and bear against lead-in surface portions 102 thereof until the axes of posts 80 are coaxial with the corresponding axes of holes 100, by alignment posts 80 perforce urging float-mounted module connector 22 incrementally laterally and precisely aligning the connectors and their matable terminals with each other appropriately for mating.

Figure 3:
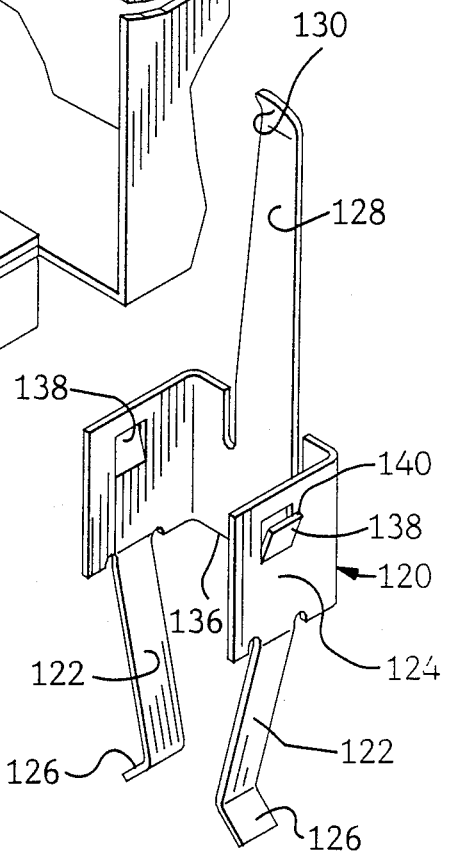
FIG. 3 is an enlarged view of one embodiment of a grounding clip of the present invention.
Figure 5:
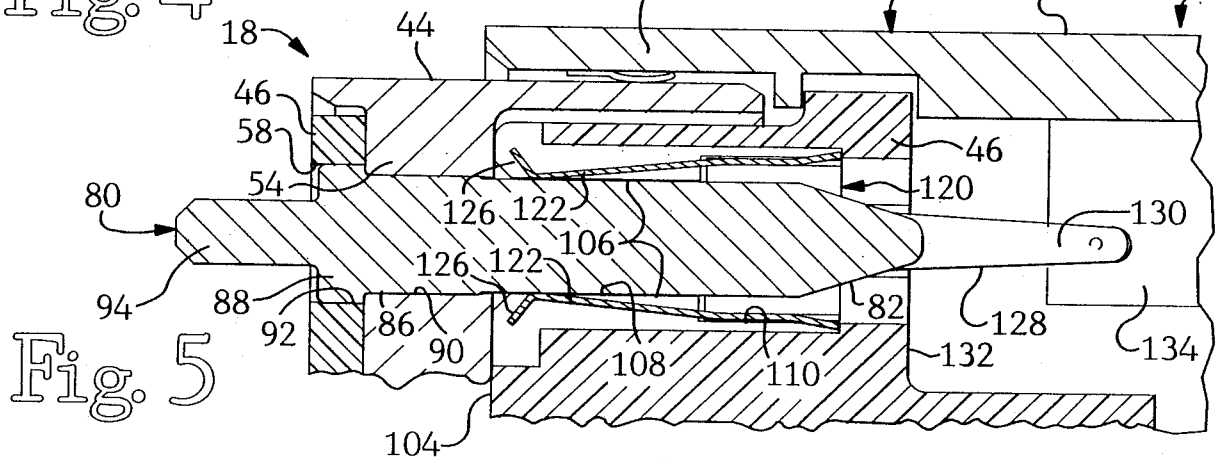

Secured within each post-receiving hole 80 is a grounding clip 120. Each grounding clip 120 as shown in FIG. 3 includes a pair of forward spring arms 122 which extend forwardly from body section 124 and radially inwardly to free ends 126 which will be disposed along the mating face 104 of module connector 22 upon assembly and preferably slightly recessed rearwardly therefrom. Free ends 126 are angled defining a lead-in, thereby being adapted to be engaged without stubbing by frustoconical forward end 82 of a respective alignment post 80 during the earliest stage of the alignment phase of connector mating, and be deflected radially outwardly thereby, as shown in FIGS. 4 and 5. Grounding clips 120 each include a rearward elongate spring arm 128 extending rearwardly from body section 124 to a free end 130 rearwardly from rearward face 132 of module connector 22. Elongate spring arm 128 extends in a direction so that during assembly of metal covers 26 to LRM 20 free end 130 is engaged and spring arm 128 is deflected against spring bias by a portion 134 of one of the metal covers 26 of LRM 20, thereafter being in conductive engagement with the cover after complete LRM assembly.

Engagement of grounding clip free ends 126 with forward ends 82 of alignment posts 80 comprises the first engagement of any portion of module connector 22 with mother board connector 18 and occurs prior to any of the terminals of either connector closely nearing any conductive portion of the other connector, thus defining the points of discharge of any electrostatic potential between the connectors. Alignment posts 80 are in conductive engagement with metal shell 44 which is fastened by fasteners 50 to support plate 14 so that its bottom surface 84 is held tightly against metal support plate 14 which is part of control unit framework 12, completing a chassis ground path for the system. This arrangement establishes assured innocuous discharge of electrostatic potential to chassis ground, termed ESD protection, preventing electrostatic potential from affecting the components or performance of the electronic package 28 of LRM 20 or other LRMs secured within control unit 10 and electrically connected to mother board 16.

Grounding clips 120 are preferably mounted and disposed in respective post-receiving holes 100 in the following manner. Body section 124 is U-shaped or rectangular and disposed within a larger rearward portion 110 of hole 100, inserted from the rearward face 132 of module connector 22, in order not to interfere with coaxial alignment of the corresponding alignment post 80 with the closely dimensioned forward hole portion 108. Transverse leading edge 136 of body section 124 abuts against ledge 112 defined between forward hole portion 108 and larger rearward hole portion 110 to stop further forward movement of grounding clip 120. Forward spring arms 122 extend forwardly along associated recesses 114 in respective ones of side walls 106 and inwardly toward the center of forward hole portion 108, and are deflectable radially outwardly into recesses 114.

Each grounding clip 120 preferably includes a pair of tabs 138 extending slightly outwardly from and rearwardly along body section 124 to ends 140 seated against a forwardly facing ledge 116 comprising the rearward end of a recess 114, upon full insertion of grounding clip 120 into post-receiving hole 100 from rearward face 132, to prevent grounding clip 120 from being urged rearwardly by the corresponding alignment post 80. By being adapted to self-engage with a portion of a metal cover of LRM 20 during assembly, grounding clip 120 simplifies connector structure and assembly. Grounding clip 120 is stamped and formed from for example beryllium copper sheet metal having a thickness of for example 0.005 inches, and each grounding clip is so shaped, dimensioned and mounted as not to interfere with receipt of alignment post 80 within post-receiving hole 100, nor to interfere with the precise coaxial alignment ability of an alignment post 80 within the corresponding post-receiving hole 100.

Figure 6:
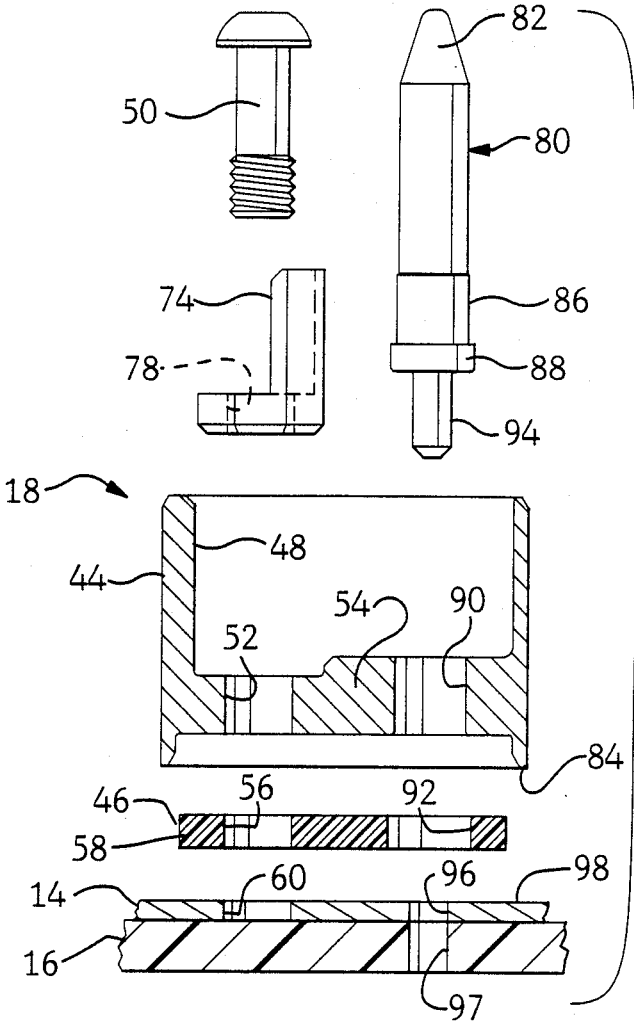
FIGS. 6 and 7 are elevation views showing an alignment post being assembled to the metal shell, connector housing, and support plate of a control unit, and fully assembled.
Figure 7:
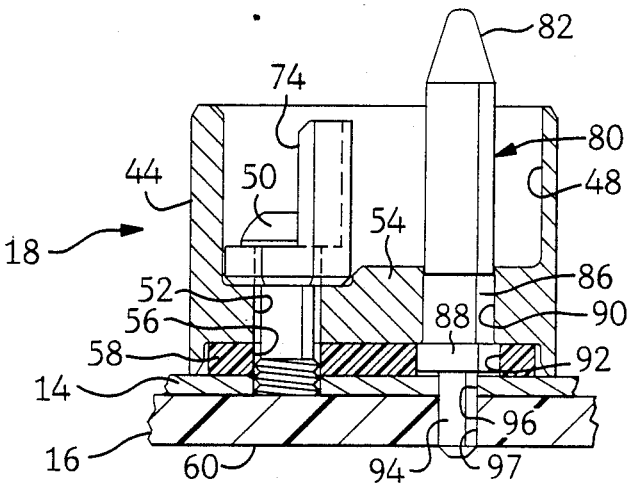

Referring to FIGS. 2B, 6 and 7, in another aspect of the present invention each alignment post 80 assists in maintaining the alignment of mother board connector housing 46 with mother board 16, and also with aligning metal shell 44 to support plate 14 of control unit framework 12, and therefore to housing 46, in addition to aligning the connectors during mating and forming part of the chassis ground path for ESD protection. Alignment posts 80 are preferably precision machined from stainless steel and passivated, to have precisely concentric coaxial portions. Intermediate portion 86 forwardly of shoulder portion 88 is dimensioned to have a diameter just larger than the diameter of aperture 90 through flange 54 of metal shell 44, and is firmly securable therewithin by interference fit. Shoulder portion 88 abuts the bottom surface of shell flange 54 and extends through hole 92 in flange 58 of dielectric housing 46 of mother board connector 18. The diameters of shoulder portion 88 and hole 92 are closely dimensioned so that hole 92 when formed with its axis precisely in reference to the terminal locations of the connector 18 holds alignment post 80 referenced to the terminal passageway 64 locations.

Rearward post end 94 extends through hole 96 through support plate 14 and hole 97 through mother board 16, and holes 96, 97 and also closely dimensioned with respect to rearward, post end 94 so that holes 96, 97 when formed with their common axis precisely in reference to the locations of plated through-holes 72, (FIG. 2) of mother board 16, hold post 80 referenced to plated through-holes 72. In this manner, alignment posts 80 hold housing 46 and shell 44 in proper position especially during assembly of control unit 10. If after assembly of metal shell 44 over housing 46 any forces are inadvertently applied to shell 44 or to alignment posts 80, rearward post ends 94 would transmit the forces to the support plate 14, assuring that upon fastening of metal shell 44 to support plate 14 no forces inadvertently tend to move shell 44 or housing 46 within cavity 48 thereof out of alignment and thereby stress and possibly damage terminals 62 or the solder connections of terminal post sections 68 with plated through-holes 72 (FIG. 2).

Fasteners 50 may be used to simultaneously secure keying elements 74 to mother board connector 18 by first extending through apertures 78 of the keying elements aligned with apertures 52 through metal shell 44, the locations of which are selected to coincide with appropriate locations of keying elements 74.

Referring to FIGS. 2B and 6, assembly of mother board connector 18 within control unit 10 can occur by inserting rearward post ends 94 of alignment posts 80 into metal shell apertures 90 until intermediate post portions 86 are force-fitted tightly in apertures 90. Mother board 16 has already been secured to and beneath support plate 14 in proper aligned relationship therewith; dielectric housing 46 has already been placed over large cutout 70 of support plate 14 with terminal post contact sections 68 extending through large cutout 70 and soldered within plated through-holes 72, and flanges 58 of housing 46 extend over portions of support plate 14 around holes 96 and apertures 60 thereof, with housing holes 92 and apertures 56 aligned therewith respectively. Metal shell 44 is placed in position over housing 46 and adjacent the top surface 98 of support plate 14 with rearward post ends 94 depending through holes 92 of housing 46 and into holes 96 of support plate 14. Keying elements 74 are placed in position with apertures 78 thereof aligned with apertures 52 of metal shell 44 and are moved into the proper selected orientation to achieve the desired keying code of the particular mother board connector 18. Fasteners 50 are inserted through apertures 78 and shell apertures 52 therebelow, through corresponding aligned apertures 56 through housing flanges 58, and are threaded into threaded holes 60 in support plate 14, completing the assembly of mother board connector 18 within control unit 10. Such assembly method permits easy disassembly for testing, service, repair and replacement of parts if necessary, and accurate reassembly with a minimum number of parts and tools.

Where the mating connectors are elongated laterally, one of the alignment post and corresponding post-receiving holes may be selected to be the primary datum or reference for the respective connector, and the other post and hole the secondary datum. The primary datum is maintained by precise dimensioning of the post-receiving hole in both dimensions of the transverse plane, both lengthwise and widthwise of the module connector. The post-receiving hole of the module connector comprising the secondary datum is oblong, being precisely dimensioned in the widthwise direction while being slightly larger in the lengthwise direction to compensate for tolerance because the manufacture of the elongated plastic housings may result in incremental differences in the lengthwise direction. Correspondingly the holes and apertures for the alignment post and fastener of the mother board connector at the end thereof considered the secondary datum, and the corresponding holes and apertures of the support plate and mother board, are also slightly oblong to allow slight tolerance compensation facilitating appropriate assembly, with the shell hole for the alignment posts being round, precisely dimensioned and fixed in location.

Figure 8:
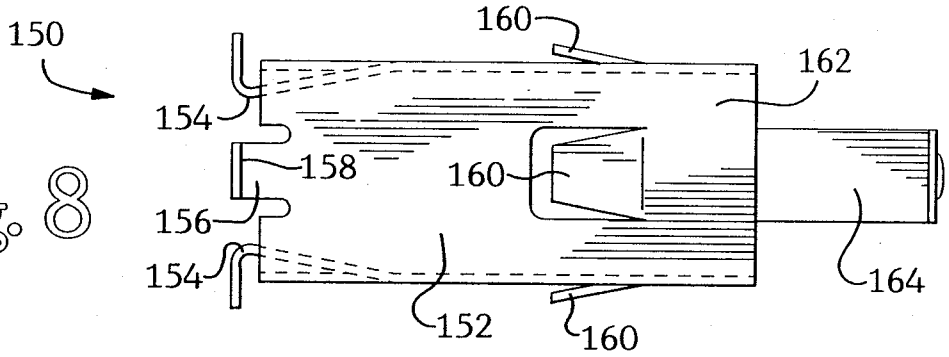
FIGS. 8 and 9 are elevation views of another embodiment of the grounding clip of the present invention, with the clip rotated 90 degrees and disposed with the module connector in FIG. 9.
Figure 9:
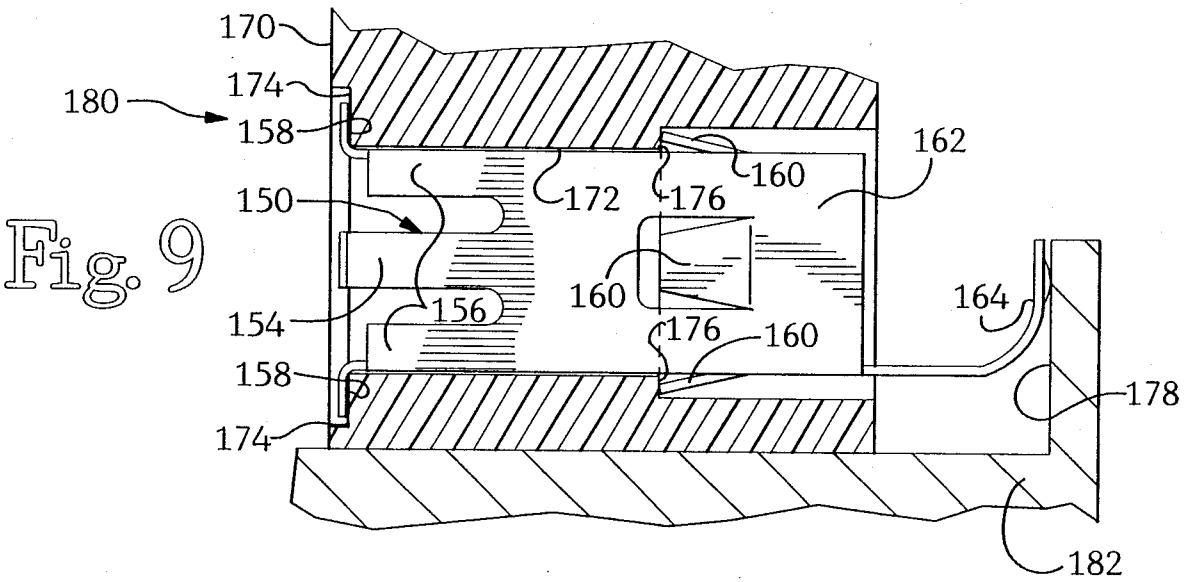

FIGS. 8 and 9 illustrate another embodiment of ESD grounding clip 150 of the present invention, having a cylindrical body section 152 disposed along a cylindrical (or slightly oblong) post-receiving hole 172 of a housing 170 module connector 180, and having a pair of forward spring arms 154 engageable early with surface portions of an alignment post of a mating connector (not shown) and be deflectable outwardly thereby. Grounding clip 150 may be stamped and formed from sheet metal, and cylindrical body section 152 may have for example a C-shape. Retention arms 156 provide means 158 for stopping rearward movement of clip 150 along the post-receiving hole at a ledge 174. Lances 160 near rearward clip end 162 extend forwardly and outwardly to engage rearwardly facing stop surfaces 176 along post receiving hole 172. A rearwardly extending spring arm 164 will conductively engage under spring bias with a portion 178 of the metal shell 182 of the module connector 180. In this embodiment body section 152 must be precisely cylindrical at least after assembly and the inner and outer diameters of body section 152 must be precisely dimensioned to maintain the precise reference of the post-receiving hole for alignment purposes, without interfering with post reception.

Various modifications may occur to the shape and design of the ESD grounding clip and in the shape and design of the alignment post and methods of mounting them, without departing from the spirit of the invention and the scope of the claims.

What is claimed is:

1. A grounding clip for an electrical connector for being engaged by forward ends of conductive alignment posts of a mating connector to establish the first engagement of portions of the connectors during precision alignment just prior to mating of the connectors, to discharge electrostatic potential between the connectors to chassis ground, comprising:

a body portion defining a post-receiving cavity and being adapted to be disposed in a post-receiving passageway of a connector housing and be secured against axial movement therealong;

at least one spring arm extending forwardly from said body section and angled inwardly to a leading end located forwardly of the leading end of said body portion to be engageable by a forward end of an alignment post of a mating connector entering said passageway from a mating face of said connector and adapted to be deflected radially outwardly by the alignment post; and means engageable with shielding around the connector upon complete assembly of the connector to groundingly engage the shielding, whereby upon engagement of the forward end of the alignment post with the leading end of the forwardly extending clip spring arm discharge of electrostatic potential occurs to chassis ground through conductive engagement of the conductive alignment post with conductive framework containing the connectors, prior to other conductive portions of the connectors at least nearly engaging.

2. A grounding clip as set forth in claim 1 wherein said body section defines a forwardly facing ledge adapted to engage a corresponding rearwardly facing ledge of said post-receiving passageway of said connector housing upon insertion of said grounding clip therein from rearwardly thereof, and said grounding clip further includes rearward stop means defined on deflectable lances extending rearwardly and outwardly from said body section be deflected inwardly during clip insertion and to resile outwardly into recess means along said passageway for said rearward stop means to engage corresponding forwardly facing ledges of said passageway, whereby the clip is insertable from rearwardly of said housing passageway and is retained therein after insertion.

3. A grounding clip as set forth in claim 1 wherein said body section defines rearwardly facing stop surfaces adapted to engage corresponding forwardly facing ledges of said post-receiving passageway of said connector housing upon insertion of said grounding clip thereinto from forwardly thereof, and said grounding clip further includes forwardly facing stop means defined on deflectable lances extending forwardly and outwardly from said body section to be deflected inwardly during clip insertion and to resile outwardly into recess means along said passageway for said forward stop means to engage corresponding rearwardly facing ledges of said passageway, whereby the clip is insertable from forwardly of said housing passageway and is retained therein after insertion.

4. A grounding clip as set forth in claim 1 wherein said body portion including forwardly facing stop means and rearwardly facing stop means adapted to cooperate with corresponding stop means along said housing passageway, at least one of said forwardly and rearwardly facing stop means being defined by projections extending outwardly from the sides of said body portion.

5. A grounding clip as set forth in claim 1 wherein said shield engageable means is an other spring arm extending from said body portion remote from said leading end of said at least one forwardly extending spring arm.

6. A connector assembly of a module connector matable with a fixedly mounted connector by being urged thereagainst along guide means which only approximately align the connector assemblies for mating, a first one of the connectors being of the type having post-receiving holes precisely positioned along the mating face thereof relative to the locations of terminals thereof, and the second one of the connectors being of the type having alignment posts precisely positioned along the mating face thereof relative to the locations of terminals thereof, the alignment posts being associated with the post-receiving holes and receivable therewithin upon the connectors being urged together along guide means of framework to which one of the connectors is fixedly mounted, the other connector being adapted to be urged incrementally laterally with respect to the guide means upon engagement of bearing surfaces at leading ends of the alignment posts and at entrances of the post-receiving holes, the connector assembly being characterized in that:

the first connector includes a grounding clip secured along each of the post-receiving holes thereof, each said grounding clip being in conductive engagement with shielding means of the first connector, each said grounding clip including at least one spring arm extending forwardly from a body section and radially inwardly to a free end along the mating face of the first connector; and the second connector includes alignment posts which are conductive and which are in conductive engagement with shielding means of the second connector, each said alignment post including a frustoconical forward end which is located forwardly of the mating face of the second connector, said alignment posts being dimensioned to just fit within respective said post-receiving holes, and the frustoconical forward ends are adapted to bear against lead-in surfaces at entrances of the post-receiving holes to move one of said first and second connectors incrementally laterally for the alignment posts to be coaxial with the post-receiving holes thereby precisely aligning the first and second connectors prior to mating thereof;

said free ends of said grounding clips being adapted to be engaged by respective portions of said frustoconical forward ends of respective said alignment posts prior to full entry of the alignment posts into the post-receiving holes and be deflected laterally thereby, and said free ends of said spring arms being so positioned as to be the first conductive portions of the first connector to be engaged by any portions of the second connector and thereby assuredly discharge thereat the electrostatic potential between the connectors to chassis ground via the framework.

7. A connector assembly as set forth in claim 6 wherein each said grounding clip body section defines a forwardly facing ledge adapted to engage a corresponding rearwardly facing ledge of said post-receiving passageway of said connector housing upon insertion of said grounding clip thereinto from rearwardly thereof, and said grounding clip further includes rearward stop means defined on deflectable lances extending rearwardly and outwardly from said body section be deflected inwardly during clip insertion and to resile outwardly into recess means along said passageway for said rearward stop means to engage corresponding forwardly facing ledges of said passageway, whereby the clip is insertable from rearwardly of said housing passageway and is retained therein after insertion.

8. A connector assembly as set forth in claim 6 wherein each said grounding clip body section defines rearwardly facing stop surfaces adapted to engage a corresponding forwardly facing ledges of said post-receiving passageway of said connector housing upon insertion of said grounding clip thereinto from forwardly thereof, and said grounding clip further includes forwardly facing stop means defined on deflectable lances extending forwardly and outwardly from said body section to be deflected inwardly during clip insertion and to resile outwardly into recess means along passageway for said forward stop means to engage corresponding rearwardly facing ledges of said passageway, whereby the clip is insertable from forwardly of said housing passageway and is retained therein after insertion.

9. A connector assembly as set forth in claim 6 wherein said shield engageable means of said grounding clip comprises an other spring arm extending from said body portion remote from said leading end of said at least one forwardly extending spring arm.

10. In combination, a circuit panel connector having alignment posts cooperable with corresponding alignment apertures of a mating connector to assure connector alignment during mating therewith, for use with circuit panels mounted to a support plate of an apparatus, the circuit panel connector including a dielectric housing having a plurality of terminals having an array of contact sections electrically connected to respective contact means of an array of contact locations of the circuit panel, and further having at least a pair of alignment posts having alignment sections extending outwardly from apertures in flange sections of the connector and away from the circuit panel to align the mating connector having the corresponding alignment apertures, the combination characterized in that:

said circuit panel is mounted to and along and adjacent said support plate in a manner which exposes said array of contact locations for electrical connection of said contact the circuit panel connector mating face so that corresponding alignment apertures of a said mating connector aligns the mating connector upon mating in order that terminal sections of corresponding terminals thereof are precisely aligned with respective said forward contact sections of said circuit panel connector;

each said alignment post includes a rearwardly extending section precisely coaxial with said forward alignment section thereof and having a first portion having a diameter corresponding to the diameter of a respective said housing aperture and a second portion corresponding to the diameter of said post-receiving support plate holes; and said alignment posts are sturdy and are positioned with said rearwardly extending sections extending through said housing apertures and said support plate holes, with said forward alignment sections extending forwardly of said circuit panel connector housing flanges in a direction away from said circuit panel for aligning engagement with corresponding alignment holes of said mating connector, said alignment posts thereby being precisely positioned simultaneously with means thereat to respective contact sections of terminals of said circuit panel connector;

said circuit panel connector is mounted to one of said support plate and circuit panel at said exposed array of contact locations of said circuit panel, with said contact sections of said terminals electrically connected to respective said contact means of said circuit panel;

at least said support plate includes post-receiving holes of selected dimension located proximate to and precisely with respect to said contact locations, and said connector flange apertures are precisely aligned with said post-receiving support plate holes and the precise positions of said flange apertures are known with respect to locations of forward contact sections of said connector terminals along respect both to said array of contact locations of said circuit panel and to said terminal locations of said housing, whereby said sturdy alignment posts transmit to said support plate via said rearwardly extending sections, lateral stress which may be received by said alignment posts during handling or connector mating and which otherwise would be transmitted to said connector housing and ultimately to its terminals and the terminations of said connector contact sections to said circuit panel contact means, thus protecting said terminations from stress.

11. The combination as set forth in claim 10 wherein said circuit panel includes post-receiving holes aligned with said post-receiving support plate holes.

12. The combination as set forth in claim 10 wherein said support plate overlies said circuit panel and includes a cutout exposing said contact locations of said circuit panel.

13. The combination as set forth in claim 10 further characterized in that said support plate and said alignment posts are conductive, and said alignment posts are in electrical connection with said conductive support plate, establishing a chassis ground for the mating connector upon engagement with corresponding ground means thereof, for grounding said mating connector.

14. The combination as set forth in claim 13 further characterized in that said assembly includes a metal shell surrounding said circuit panel connector and said alignment posts extend through apertures of said metal shell.

15. A method of assembling and mounting a shielded circuit panel connector to a support plate of framework of an apparatus containing the circuit panel in a precisely located position with respect to the support plate so that terminal locations of the connector are precisely aligned with corresponding contact locations of the circuit panel also mounted to the support plate, the connector being of the type having a dielectric housing containing a plurality of terminals and a metal shell therearound and further having a plurality of alignment posts extending forwardly thereof to provide for alignment with another connector during mating therewith, comprising the steps of:

establishing post-receiving holes at least in the support plate which are located proximate to and precisely with respect to contact locations of the circuit panel and have a selected diameter, and providing a cutout through the support plate exposing the array of contact locations of the circuit panel;

selecting a connector housing having terminals secured therewithin corresponding to the array of contact locations of the circuit panel and having contact sections extending rearwardly from the housing, said connector housing having flanges which overlie said post-receiving holes through the support plate and have apertures therethrough aligned with said holes when said contact sections are aligned with said circuit panel contact locations;

forming a metal shell for the connector adapted to be placed over said connector housing after said housing is mounted on said circuit panel and is disposed adjacent the support plate, said metal shell having flanges which overlie said housing flanges and have apertures therethrough alignable with said apertures through said housing flanges when said metal shell is placed over said housing;

selecting sturdy alignment posts having forward alignment sections, intermediate sections and rearwardly extending sections, said forward alignment sections, said intermediate sections and said rearwardly extending sections of each said alignment post being precisely coaxial, said intermediate section of each having a diameter just larger than the diameter of a said shell aperture, and said rearwardly extending section thereof having a first portion having a diameter corresponding to the diameter of a said housing aperture and a second portion corresponding to the diameter of said post-receiving support plate holes;

securing said alignment posts to said metal shell by extending a smaller diameter end of each through a respective said shell aperture and force-fitting said intermediate section within said shell aperture, said forward alignment sections extending forwardly of said metal shell to extend in a direction away from the circuit panel upon complete connector assembly and mounting for aligning engagement with corresponding alignment holes of the mating connector;

placing said connector housing on the support plate with said contact sections extending through said cutout and said flanges overlying said post-receiving holes with said apertures aligned therewith, and securing said contact sections to respective contact means at said circuit panel contact locations;

placing said metal shell having said alignment posts secured thereto over said connector housing with said rearwardly extending sections extending through said housing apertures and said support plate holes; and fastening said metal shell to the support plate, whereby after said rearwardly extending alignment post sections enter said support plate holes, said sturdy alignment posts transmit to said support plate incidental lateral stress which may be received by said metal shell or said alignment posts during subsequent control unit assembly, handling or connector mating, thus protecting said terminations after assembly from stress which otherwise would be transmitted by said metal shell or said alignment posts to said housing and its terminals and the terminations of the connector contact sections to the circuit panel contact means.

16. A method as set forth in claim 15 wherein keying members for the connector include apertures therethrough, said metal shell flanges include fastener-receiving holes therethrough at selected locations corresponding to key locations of a mating connector, and the support plate includes hole therethrough aligned with said fastener-receiving holes when said metal shell is placed over said connector housing with said alignment post rearwardly extending sections disposed in said aligned holes, and said fastening step comprises placing said keying members adjacent said shell flanges with said apertures therethrough aligned with said fastener-receiving holes and said keying members in appropriate keying orientation, and inserting a fastening end of a fastener member shank through each said thus-aligned keying member aperture, said fastener-receiving hole and said support plate hole, and securing said fastening end to the support plate.

17. A method of assembling and mounting a circuit panel connector to a support plate of framework of an apparatus containing the circuit panel in a precisely located position with respect to the support plate so that terminal locations of the connector are precisely aligned with corresponding contact locations of the circuit panel also mounted to the support plate, the connector being of the type having a dielectric housing containing a plurality of terminals and further having a plurality of alignment posts extending forwardly thereof to provide for alignment with another connector during mating therewith, comprising the steps of:

establishing post-receiving holes at least in said support plate which are located proximate to and precisely with respect to contact locations of said circuit panel and have a selected diameter, said circuit panel and said support plate being secured together in a manner such that the assembly exposes said array of contact locations of said circuit panel;

selecting a connector housing having terminals secured therewithin corresponding to said array of contact locations of said circuit panel and having terminal contact sections connectable to panel contact means at said contact locations, said connector housing having flanges which overlies said post-receiving support plates holes, said flanges having apertures therethrough aligned with said holes when said terminals contact sections are aligned with said circuit panel contact locations;

selecting sturdy alignment posts including a forward alignment sections and rearwardly extending sections, said forward alignment sections and said rearwardly extending sections of each said alignment post being precisely coaxial, said rearwardly extending sections thereof each having a first portion having a diameter corresponding to the diameter of a said housing aperture and a second portion corresponding to the diameter of a said post-receiving support plate hole;

placing said connector housing on said support plate with said terminal contact sections aligned with said circuit panel contact locations and said flanges overlying said post-receiving support plate holes with said apertures aligned therewith and securing said terminal post sections to respective said contact means at said circuit panel contact locations;

positioning said alignment posts with said rearwardly extending sections extending through said housing apertures and said post-receiving support plate holes, with said forward post sections extending forwardly of said housing flanges in a direction away from said circuit panel upon complete connector assembly and mounting for aligning engagement with corresponding alignment holes of said mating connector, thereby simultaneously positioning said alignment posts precisely with respect both to said array of contact locations of said circuit panel and to said terminal locations of said housing; and fastening said connector housing and said alignment posts to one of said support plate and said circuit panel, whereby after said rearwardly extending alignment post sections enter said support plate holes, said sturdy alignment posts transmit to said support plate incidental lateral stress which may be received by said alignment posts during subsequent control unit assembly, handling or connector mating, thus protecting said terminations after assembly from stress which otherwise would be transmitted by said alignment posts to said housing and its terminals and the terminations of the connector contact sections to the circuit panel contact means.

18. The method as set forth in claim 17 further including the step of providing post-receiving holes in said circuit panel aligned with said post-receiving holes of said support plate.

19. The method as set forth in claim 12 further including the step of providing a cutout in said support plate exposing said contact locations of said circuit panel.

* * * * *

UNITED STATES PATENT AND TRADEMARK OFFICE

CERTIFICATE OF CORRECTION

PATENT NO. : 4,925,400

DATED : May 15, 1990

INVENTOR(S) : Bryce W. Blair, et al

It is certified that error appears in the above-identified patent and that said Letters Patent is hereby corrected as shown below:

In the Claims:

Claim 2, Column 9, line 68 - Change "therein" to --thereinto--.

Claim 10, Column 12, line 11 - After "contact" insert:
--means thereat to respective contact sections of terminals of said circuit panel connector;
said circuit panel connector is mounted to one of said support plate and circuit panel at said exposed array of contact locations of said circuit panel, with said contact sections of said terminals electrically connected to respective said contact means of said circuit panel;
at least said support plate includes post-receiving holes of selected dimension located proximate to and precisely with respect to said contact locations, and said connector flange apertures are precisely aligned with said post-receiving support plate holes and the precise positions of said flange apertures are known with respect to locations of forward contact sections of said connector terminals along.--

Claim 10, Column 12, line 35 - Delete "means thereat to re-"; and lines 36 to 51 - delete in entirety.

Claim 16, Column 14, line 38 - Change "hole" to --holes--.

UNITED STATES PATENT AND TRADEMARK OFFICE

CERTIFICATE OF CORRECTION

PATENT NO. : 4,925,400

DATED : May 15, 1990

INVENTOR(S) : Bryce W. Blair, et al

It is certified that error appears in the above-identified patent and that said Letters Patent is hereby corrected as shown below:

Claim 19, Column 16, line 30, change "claim 12" to --claim 17--.

Signed and Sealed this

Seventeenth Day of December, 1991

*Attest:*

HARRY F. MANBECK, JR.

*Attesting Officer*

*Commissioner of Patents and Trademarks*